US011406179B2

(12) United States Patent
Grabowski et al.

(10) Patent No.: US 11,406,179 B2
(45) Date of Patent: Aug. 9, 2022

(54) MOVABLE TABLE WITH ANGLED LEG AND ASSEMBLY OF THE SAME

(71) Applicants: Daniel Grabowski, East Grand Rapids, MI (US); Michael Johnson, West Olive, MI (US)

(72) Inventors: Daniel Grabowski, East Grand Rapids, MI (US); Michael Johnson, West Olive, MI (US)

( * ) Notice: Subject to any disclaimer, the term of this patent is extended or adjusted under 35 U.S.C. 154(b) by 0 days.

(21) Appl. No.: 17/096,222

(22) Filed: Nov. 12, 2020

(65) Prior Publication Data

US 2022/0142357 A1 May 12, 2022

(51) Int. Cl.
*A47B 13/02* (2006.01)
*A47B 9/20* (2006.01)

(52) U.S. Cl.
CPC ..... *A47B 13/023* (2013.01); *A47B 9/20* (2013.01); *A47B 2013/024* (2013.01)

(58) Field of Classification Search
CPC ..... A47B 2013/024; A47B 13/02; A47B 2013/006; A47B 2200/0021; A47B 2200/0023
See application file for complete search history.

(56) References Cited

U.S. PATENT DOCUMENTS 3,742,870 A * 7/1973 Gusdorf ..... A47B 13/023 108/150
4,078,757 A * 3/1978 Waters ..... A47B 19/02 108/150
4,494,754 A * 1/1985 Wagner, Jr. ..... A63F 13/02 273/148 B
4,807,838 A * 2/1989 Anderson ..... A47B 13/023 248/188
5,207,791 A * 5/1993 Scherbarth ..... A63F 13/08 273/148 B
5,868,079 A * 2/1999 Charny ..... F16M 11/42 108/7
7,823,518 B2 * 11/2010 Phillips ..... A47B 21/00 108/43
8,746,156 B2 * 6/2014 Camarillo ..... F16M 11/22 108/150
10,941,898 B1 * 3/2021 McCall ..... F16M 11/046
2001/0045497 A1 * 11/2001 Coonan ..... A47B 21/00 248/123.11
2003/0160139 A1 * 8/2003 Camarota ..... A47B 13/021 248/188

* cited by examiner

*Primary Examiner* — Daniel J Rohrhoff

(74) *Attorney, Agent, or Firm* — Gutwein Law; Greg N. Geiser

(57) ABSTRACT

A movable table assembly comprising a base portion and a table support each having angular connecting nub with an interior cavity to enable fastening inline with a support leg. The preferred assembly utilizes a base portion, a support leg, a table support, and a table. The base portion and table support being generally planar and having a first side and second side defined by an edge around a perimeter. The support leg coupled between the base portion and table support to generally provide a movable work surface, wherein the table and base portion are generally positioned parallel to a ground surface despite the angular connection.

13 Claims, 4 Drawing Sheets

MOVABLE TABLE WITH ANGLED LEG AND ASSEMBLY OF THE SAME

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

This invention relates generally to an angled table leg assembly generally supporting a work surface, such as a table for a laptop. In one aspect, the assembly is comprised of a base portion, connecting leg, and support configured for easy movability and support of an electronic device during the completion of work tasks.

BACKGROUND

In the furniture industry, it is known that consumer desire supporting elements, such as tables, to provide a resting surface for objects and equipment for use and storage. One such table element is generically referred to as a laptop table, C-shaped table, end table, or sofa table. Typically, these tables have a base member, a leg or riser element, and a table surface arranged in a configuration where the leg or riser element is placed towards an edge of the base member and table surface. This configuration of the base, leg, and table surface allows the table to placed closely to the user or positioned under an existing piece of furniture to enable the table surface to be in close proximity to the user.

In a standard assembly for this type of table, the base portion, leg and table surface are provided in horizontal and vertical sections with the connection angles being approximately ninety degrees. Although this is the standard connection, it is more desirable to have the connections being angular to allow for great comfort and flexibility in the use of the device. Unfortunately, this angular connection is prone to failure as the connection between the base portion, leg, and surface is not properly secure. To combat this problem, several assemblies utilize a lived assembly, wherein the base portion, leg portion, and surface supporting portion are configured of a singular fixed assembly without the use of fasteners. Although useful, this fixed assembly results in higher manufacturing, material, and shipping costs.

There exists a need to provide a table assembly of this type having a single angular leg or stem that is secured to the base member and surface in a robust connection though an assembly utilizing fasteners or fastening. Accordingly, this assembly is configured to provide improvements in shipping and material costs. Preferably, this connection is specifically adapted for angular fastening and configured in an assembly that does not apply a counter-directional force when fastening to ensure a solid and robust connection between portions when assembled.

BRIEF SUMMARY OF THE INVENTION

In one aspect, this disclosure is related to a furniture type having a single leg or stem for connecting a base portion to a resting surface to provide a convenient use.

In another aspect, this disclosure is related to base portion and table support having angular connecting portion to enable fastening inline with a supporting leg or stem.

The preferred assembly of the disclosed device utilizes a base portion, a support leg, a table support, and a table. The base portion being generally planar and having a first side and second side defined by an edge around a perimeter, with the first side generally designated as a top side and the second side generally designated as a bottom side. The base portion is configured for resting on a floor surface, with the second side adjacent and in contact with the floor surface during use. The preferred shape of the base portion being rectangular, but other shapes can be utilized. The base portion including a first connecting nub generally placed adjacent to the edge near the perimeter. The first connecting nub extending a height from the first side opposite the second side at an angle, wherein the first connecting nub is integrated directly within the construction of the base to form a cohesive structure. The second side having a cavity aligned with the nub and including a plurality of apertures. The apertures sized for the receipt of a corresponding plurality of fasteners to aid in securing the supporting leg.

The table support configured to work in cooperation with the base portion and supporting leg. The table support generally mirroring the structure of the base portion with the table support being generally planar and having a first side and second side defined by an edge around a perimeter, with the first side generally designated as a top side and the second side generally designated as a bottom side. The table support is configured for attachment of a table surface on the first side, with the second side adjacent and affixed to the supporting leg during use. The preferred shape of the table support being rectangular, but other shapes can be utilized. The table support also including a second connecting nub generally placed adjacent to the edge near the perimeter and directionally aligned with the first connecting nub of the base portion. The second connecting nub extending a height from the second side opposite the first side at the angle, wherein the second connecting nub is integrated directly within the construction of the table support to form a cohesive structure. With the angle of the base portion and the table support being the same, the supporting leg is connected without additional and unnecessary torque on the fasteners. The table support first side having a cavity aligned with the second connecting nub and including a plurality of apertures. The apertures sized for the receipt of a corresponding plurality of fasteners to aid in securing the supporting leg to the table support.

The supporting leg having a first end and a second end, with a distance between the first end and the second end defining a length of the supporting leg. The first end configured for coupling with the base portion and the second end configured for coupling with the table support. In the preferred embodiment of the present disclosure, the supporting leg is provided with a fixed length. In an alternate embodiment of the present disclosure, the supporting leg has an adjustable length through the use of a telescopic assembly capable of expansion and contraction.

In the preferred assembly, the base portion and table support are diecast to provide a robust and durable assembly, wherein the first connecting nub and second connecting nub are cast directly into the base portion and table support to create a cohesive and robust assembly.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
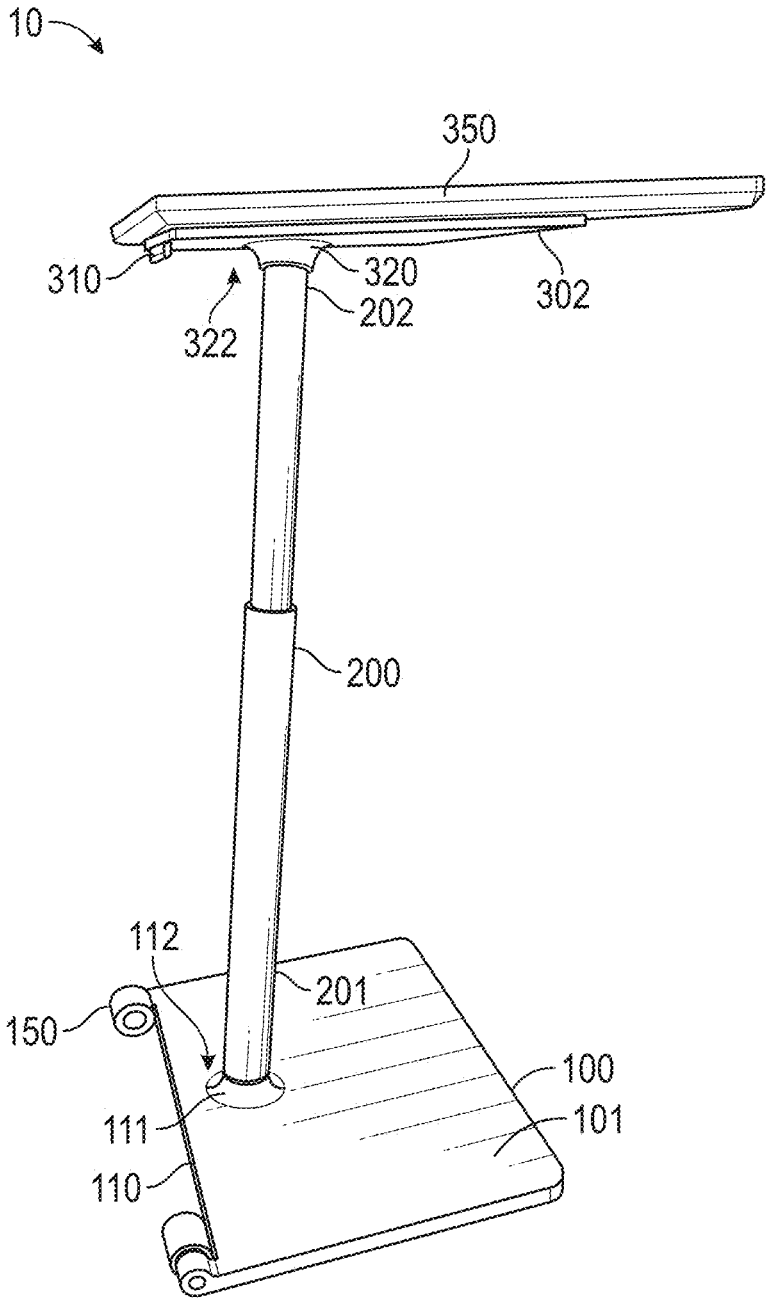
FIG. 1 is an isometric view of movable table with angled leg and assembly, according to the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination or the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Figure 2:
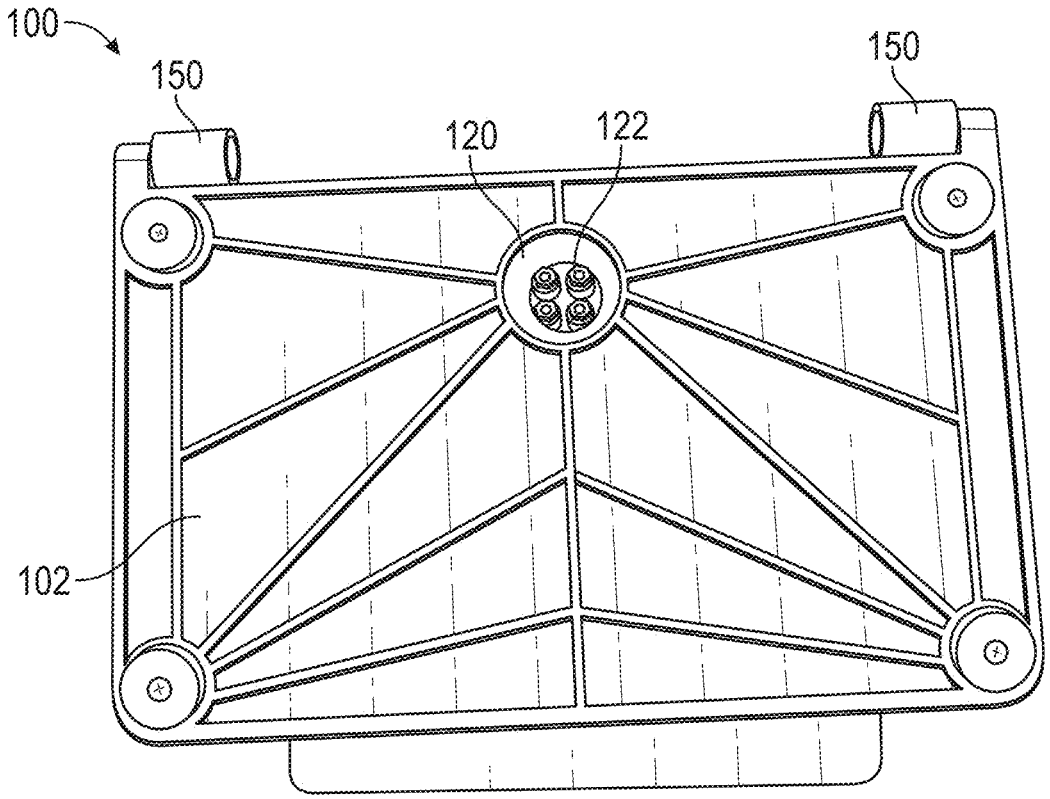
FIG. 2 is a view of the base portion second side, according to the present disclosure.
Figure 3:
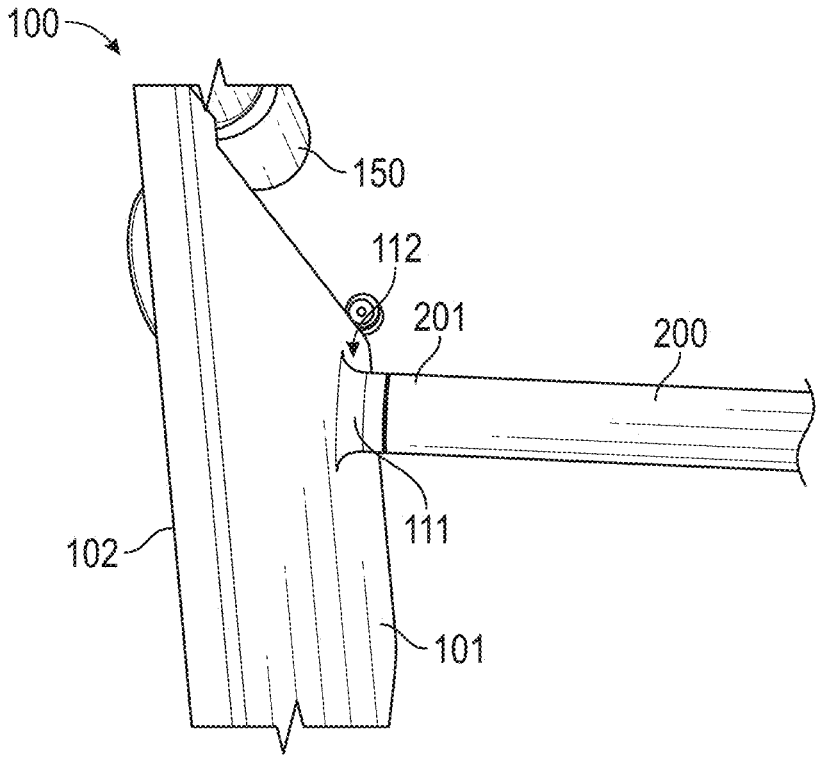
FIG. 3 is a side view of the base portion and the support leg connection, according to the present disclosure.
Figure 4:
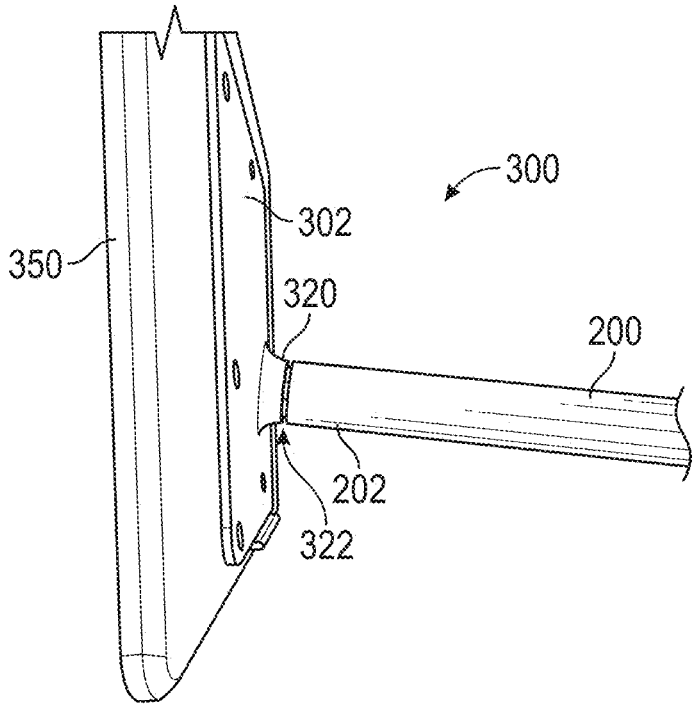
FIG. 4 is a side view of the table support and the support leg connection with a table, according to the present disclosure.
Figure 5:
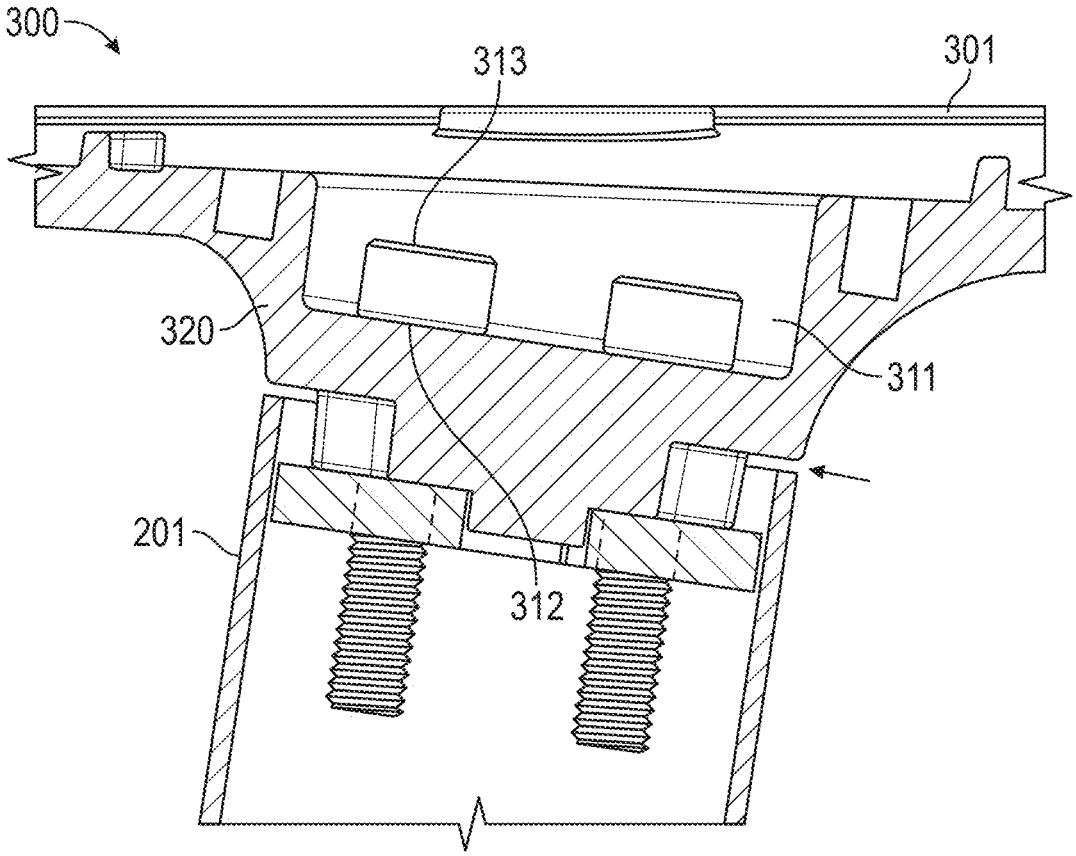
FIG. 5 is a cross sectional view of the table support and the support leg connection, according to the present disclosure.
Figure 6:
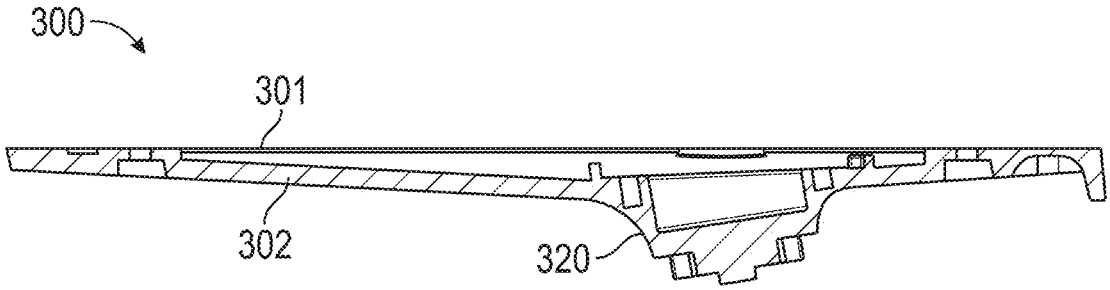
FIG. 6 is a cross section view of the of the table support and second connecting nub, according to the present disclosure.

Referring now to FIGS. 1-6 of the movable table with angled leg and assembly of the same, generally referred to as device 10. The device 10 is most generally configured with three major parts in a connected assembly in the form of a base portion 100, a support leg 200, and a table support 300, supporting a table 350. The device 10 can be generally described as a type of furniture that is easily moved and most applicable for supporting a personal electronic device, such as, but not limited to a laptop style personal computer, while a user is in a seated or standing position. The device 10 assembly allows the table 350 to be positioned close to the user without interference from the base portion 100 supporting the table 350.

The base portion 100 being planar and having a first side 101 and second side 102 opposed the first side 101. The base portion 100 defined by an edge 110 around a perimeter, with the first side 101 generally designated as a top side and the second side 102 generally designated as a bottom side. The base portion 100 is configured for resting on a floor surface, with the second side 102 adjacent and in contact with the floor surface during use. The preferred shape of the base portion 100 is rectangular, but other shapes can be utilized without departing from the spirit of the inventive concept of the disclosure. The base portion 100 including a first connecting nub 111 generally placed adjacent to the edge 110 near the perimeter. The first connecting nub 111 extending a height from the first side 101 opposite the second aide 102 at a first angle 112, wherein the first connecting nub 111 is integrated directly within the construction of the base portion 100 to form a cohesive structure. The first angle 112 of the first connecting nub 111 being obtuse when measured along an axis of the planar surface of the base portion relative to the edge 110.

The base portion second side 102 having a cavity 120 aligned with the first connecting nub 111, wherein the cavity 120 is generally an interior portion of the first connecting nub 111. The cavity 120 including a plurality or apertures 121. The plurality of apertures 121 sized for the receipt of a corresponding plurality of fasteners 122 configured for receipt with corresponding sockets in a first end 201 of the support leg 200 to aid in securing the support leg 200 to the base portion 100. Accordingly, to ensure a robust connection between the support leg 200 and base portion 100, the first connecting nub 111 height has a tilt corresponding directionally to the first angle 112 to enable the first end 201 of the support leg 200 to be secured parallel with a direction of a length of the plurality of fasteners 122. Therefore, the support leg 200 and first connecting nub 111 assembly is inline to prevent failure of the connection and ensure a robust and durable fastening.

The table support 300 configured to work in cooperation with the base portion 100 and supporting leg 200 to form a cohesive and assembled device 10. The table support 300 generally mirroring the structure of the base portion 100 with the table support 300 being generally planar and having a first side 301 and second side 302 defined by an edge 310 around a perimeter, with the first side 301 generally designated as a top side and the second side 3032 generally designated as a bottom side. The table support 300 is configured for attachment of the table surface 350 on the first side 301, with the second side 302 adjacent and affixed to the supporting leg 200 during use.

The preferred shape of the table support 300 being generally rectangular, but other shapes can be utilized. The table support 300 also including a second connecting nub 320 generally placed adjacent to the edge 310 near the perimeter and directionally aligned with the first angle 112 and the first connecting nub 110 of the base portion 100. The second connecting nub 320 extending a height from the second side 320 opposite the first side 301 at a second angle 322, wherein the second connecting nub 320 is integrated directly within the construction of the table support 300 to form a cohesive structure generally mirroring the structure of the base portion 100. The second angle 322 being supplementary to the first angle 112 and acute when measured along an axis of the planar surface of the table support 300 relative to the edge 310, wherein the angular positioning of the first connecting nub 110 and second connecting nub 320 will be the same when placed along the same plane. Accordingly, when viewed from the side, as in FIG. 1, the table support 300 and base portion 100 are positioned parallel to each other relative to the surface the device 10 is placed upon.

The table support first side 301 having a cavity 311 aligned with the second connecting nub 320, wherein the cavity 311 is generally an interior portion of the second connecting nub 320. The cavity 311 including a plurality of apertures 312. The plurality of apertures 312 sized for the receipt of a corresponding plurality of fasteners 313 configured for receipt with corresponding sockets in a second end 202 of the support leg 200 to aid in securing the support leg 200 to the table support 300. Accordingly, to ensure a robust connection between the support leg 200 and the table support 300, the second connecting nub 320 height has a tilt corresponding directionally to the second angle 322 to enable the second end 202 of the support leg 200 to be secured parallel with a direction of a length of the fasteners 313. Therefore, the support leg 200 and second connecting nub 320 assembly is in line to prevent failure of the connection and ensure a robust and durable fastening of the parts. Accordingly, with the angled positioning of the first connecting nub 110 and the second connecting nub 320 of the base portion 100 and the table support 300, the supporting leg is connected without additional and unnecessary torque on the fasteners.

The support leg 200 having the first end 201 and the second end 202, with a distance between the first end 201 and the second end 202 defining a length of the support leg 200. The first end 201 configured for coupling with the base portion 100 and the second end 202 configured for coupling with the table support 300. In the preferred embodiment of the present disclosure, the support leg 200 is provided with a fixed length. In an alternate embodiment of the present disclosure, the support leg 200 has an adjustable length through the use of a telescopic and nested assembly 203 capable of expansion and contraction to generally adjust the height of the table surface 350 relative to the ground surface the device 10 is placed upon.

In the preferred assembly, the base portion 100 and table support 300 are diecast to provide a robust and durable assembly, wherein the first connecting nub 110 and second connecting nub 320 are cast directly into the base portion and table support to create a cohesive and robust assembly.

In an alternate embodiment of the present disclosure, the base portion 100 is configured with a pair of wheels 150 positioned along the edge 310 to allow for easy movement of the device 10. Accordingly, the pair of wheels 150 may be slightly raised off the surface and positioned exterior to the base portion 100 to only engage when the device 10 is slightly titled directionally towards the pair of wheels 150.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A movable table configured to provide an easily moved surface for the resting of an object, the movable table comprising:

a base portion, the base portion comprising:

a first side;

an edge;

a first connecting nub, the first connecting nub positioned on the first side adjacent to the edge at a first angle, the first connecting nub extending a height opposite a second side, the first angle being obtuse when measured along an axis of the base portion from the edge to the first connecting nub; and the second side opposed the first side, the second side having a cavity corresponding to an interior of the first connecting nub, the cavity including a plurality of apertures;

a table support, the table support comprising:

a second side;

an edge;

a second connecting nub, the second connecting nub positioned on the second side adjacent to the edge at a second angle, the second connecting nub extending a height opposite a first side, the second angle being acute when measured along an axis of the table support from the edge to the second connecting nub, wherein the first angle and the second angle are supplementary;

the first side opposed the second side, the first side having a cavity corresponding to an interior of the second connecting nub, the cavity including a plurality of apertures; and a support leg, the support leg having a first end and a second end opposed the first end and defining a length of the support leg, the first end coupled to the first connecting nub through a plurality of fasteners received within the plurality of apertures of the first connecting nub and the second end coupled to the second connecting nub through a plurality of fasteners received within the plurality of apertures of the second connecting nub; and a table, the table coupled to the table support.

2. The movable table of claim 1, wherein the base portion includes a pair of wheels.

3. The movable table of claim 1, wherein the first connecting nub and the second connecting nub are angled such that the table and the base portion are parallel along an axis of a surface the movable table is placed upon.

4. The movable table of claim 1, wherein the first connecting nub is integrated within the base portion as a singular assembly and wherein the second connecting nub is integrated with the table support as a singular assembly.

5. The movable table of claim 1, wherein the support leg length is fixed.

6. The movable table of claim 1, wherein the support leg length is adjustable.

7. A movable table assembly configured to provide an easily moved surface for the resting of an object, the movable table assembly comprising:

a base portion, the base portion comprising:

a first side;

an edge;

a first connecting nub, the first connecting nub integrated within the base portion and positioned on the first side adjacent to the edge at a first angle, the first connecting nub extending a tilted height opposite a second side, the first angle being obtuse when measured along an axis of the base portion from the edge to the first connecting nub; and the second side opposed the first side, the second side having a cavity corresponding to an interior of the first connecting nub, the cavity including a plurality of apertures;

a table support, the table support comprising:

a second side;

an edge;

a second connecting nub, the second connecting nub integrated within the table support, the second connecting nub positioned on the second side adjacent to the edge at a second angle, the second connecting nub extending a tilted height opposite a first side, the second angle being acute when measured along an axis of the table support from the edge to the second connecting nub, wherein the first angle and the second angle are supplementary;

the first side opposed the second side, the first side having a cavity corresponding to an interior of the second connecting nub, the cavity including a plurality of apertures; and a support leg, the support leg having a first end and a second end opposed the first end and defining a length of the support leg, the first end coupled to the first connecting nub through a plurality of fasteners received within the plurality of apertures of the first connecting nub and the second end coupled to the second connecting nub through a plurality of fasteners received within the plurality of apertures of the second connecting nub, wherein the tilted height and first angle of the first connecting hub and the tilted height and second angle of the second connecting hub allow the support leg to be coupled directionally in line with the first connecting nub and the second connecting nub; and a table, the table coupled to the table support.

8. The movable table of claim 7, wherein the base portion includes a pair of wheels.

9. The movable table of claim 8, where the pair of wheels are positioned along the edge of the base portion.

10. The movable table of claim 7, wherein the first connecting nub and the second connecting nub first angle and second angle are angled such that the table and the base portion are parallel along an axis of a surface the movable table is placed upon.

11. The movable table of claim 7, wherein the support leg length is fixed.

12. The movable table of claim 7, wherein the support leg length is adjustable.

13. The movable table of claim 7, wherein the base portion and table support are constructed out of a die cast metal alloy.

* * * * *